US006881892B2

(12) United States Patent
Miyazaki et al.

(10) Patent No.: US 6,881,892 B2
(45) Date of Patent: Apr. 19, 2005

(54) METHOD OF CONFIGURATING ACOUSTIC CORRECTION FILTER FOR STRINGED INSTRUMENT

(75) Inventors: Hideo Miyazaki, Hamamatsu (JP); Shinji Kishinaga, Hamamatsu (JP); Youjiro Takabayashi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 258 days.

(21) Appl. No.: 10/370,328

(22) Filed: Feb. 18, 2003

(65) Prior Publication Data

US 2004/0025675 A1 Feb. 12, 2004

(30) Foreign Application Priority Data

Feb. 19, 2002 (JP) ..... 2002-042108

(51) Int. Cl.[7] ..... G10H 1/12

(52) U.S. Cl. ..... 84/736; 84/603; 84/661; 84/728; 84/735; 84/DIG. 9

(58) Field of Search ..... 84/600, 603, 616, 84/622–625, 659–661, 725–728, 730–731, 735–736, DIG. 9

(56) References Cited

U.S. PATENT DOCUMENTS 5,142,961 A * 9/1992 Paroutaud ..... 84/726
5,521,329 A * 5/1996 Yamauchi et al. ..... 84/661
5,587,548 A * 12/1996 Smith, III ..... 84/659
6,437,226 B1 * 8/2002 Oudshoorn et al. ..... 84/454
6,479,740 B1 * 11/2002 Schwartz et al. ..... 84/609
6,627,806 B1 * 9/2003 Carpenter ..... 84/454
6,737,572 B1 * 5/2004 Jameson et al. ..... 84/741

FOREIGN PATENT DOCUMENTS

JP 3027699 5/1996

* cited by examiner

*Primary Examiner*—Marlon T. Fletcher
(74) *Attorney, Agent, or Firm*—Morrison & Foerster LLP

(57) ABSTRACT

A method is provided for designing an acoustic correction filter applicable to a stringed instrument, which is composed of a string member operable to undergo a vibration, a support member for supporting the string member, a body member responsive to the vibration transmitted through the support member for generating a natural sound and a mute attachment for muting the natural sound. The acoustic correction filter is operable when the natural sound is muted by the mute attachment for filtering a signal derived from the vibration so as to create an artificial sound instead of the muted natural sound. The method is carried out by the steps of acquiring a first sample signal from the vibration under a mute state, acquiring a second sample signal from the vibration under a free state, extracting a difference between the acquired first sample signal and the acquired second sample signal, and determining a correction characteristic of the acoustic correction filter based on the extracted difference such that the acoustic correction filter can filter the signal in accordance with the determined correction characteristic so as to create the artificial sound comparable to the natural sound.

9 Claims, 11 Drawing Sheets

METHOD OF CONFIGURATING ACOUSTIC CORRECTION FILTER FOR STRINGED INSTRUMENT

BACKGROUND OF THE INVENTION

1. Technical Field of the Invention

The present invention relates to an acoustic signal output apparatus that corrects a signal detected from a vibration of a stringed instrument and outputs an acoustic signal, a filter characteristics determination apparatus for an acoustic correction filter used in the acoustic signal output apparatus, and methods of designing and forming the acoustic correction filter.

2. Prior Art

Conventionally, there is used an electric stringed instrument simulating a natural stringed instrument such as a violin and the like. The electric stringed instrument uses a pickup to detect a string vibration and amplifies the detected signal for output of sound. Such an electric stringed instrument enables a so-called mute performance in which a detected signal is output to a headphone and the like. The electric stringed instrument is very useful as a musical training tool used for practice in a situation where it is not permitted to generate a loud musical sound.

However, the electric stringed instrument does not have an acoustic structure such as a resonance body that is essential to the natural stringed instrument. Accordingly, the electric stringed instrument differs from the natural stringed instrument in performance feelings and the like.

There is available a method of enabling an instrumental performance that does not generate a loud musical sound while maintaining performance feelings of the natural stringed instrument. More specifically, a mute member is attached to a bridge member of the natural stringed instrument to suppress transmission of the string vibration to the resonance body and the like while providing a dummy sound instead of the natural sound.

PROBLEMS TO BE SOLVED BY THE INVENTION

According to such technique of attaching the mute member, however, a player or the like cannot hear the true musical sound generated during his or her performance. As a solution, a sophisticated instrument has been designed to use a pickup to detect vibration of a bridge member or the like arrested by the mute member, and amplify and output the detected signal to headphones and the like. This technique realizes the performance without generating a loud sound while maintaining performance feelings of natural musical instruments.

However, when the electric signal is detected from the vibrated bridge of the stringed instrument arrested by the mute member and is amplified for output, the quality of the musical sound heard from headphones and the like degrades in comparison with natural musical sound generated from the resonance body or the like with no mute member attached.

SUMMARY OF THE INVENTION

The present invention has been made in consideration of the foregoing. It is therefore an object of the present invention to provide an acoustic signal output apparatus, methods of designing and forming an acoustic correction filter, and a filter characteristics determination apparatus capable of outputting a realistic musical sound based on a signal obtained from string vibration despite attachment of a vibration suppression means such as a mute member.

In order to solve the above-mentioned problems, there is provided a method of designing an acoustic correction filter applicable to a stringed instrument composed of a string member operable to undergo a vibration, a support member for supporting the string member, a body member responsive to the vibration transmitted through the support member for generating a natural sound and a mute attachment for muting the natural sound. The acoustic correction filter is operable when the natural sound is muted by the mute attachment for filtering a signal derived from the vibration so as to create an artificial sound instead of the muted natural sound. The inventive method comprises the steps of acquiring a first sample signal from the vibration under a mute state where the transmittance of the vibration to the body member is suppressed by the mute attachment to mute the natural sound, acquiring a second sample signal from the vibration under a free state where the body member is allowed to generate the natural sound in response to the vibration transmitted to the body member, extracting a difference between the acquired first sample signal and the acquired second sample signal, and determining a correction characteristic of the acoustic correction filter based on the extracted difference such that the acoustic correction filter can filter the signal in accordance with the determined correction characteristic so as to create the artificial sound comparable to the natural sound.

Practically, the step of extracting comprises deriving a first amplitude profile of the first sample signal along a common frequency axis, deriving a second amplitude profile of the second sample signal along the common frequency axis, and extracting the difference between the first sample signal and the second sample signal in terms of an amplitude difference between the first amplitude profile and the second amplitude profile along the common frequency axis, and the step of determining determines the correction characteristic of the acoustic correction filter based on the extracted amplitude difference.

Expediently, the step of determining further comprises inverting a frequency characteristic of the second sample signal, collecting an acoustic signal corresponding to the natural sound from a particular location under the free state where the natural sound is generated by the body member of the stringed instrument, and further determining the correction characteristic of the acoustic correction filter based on the inverted frequency characteristic of the second sample signal and a characteristic of the collected acoustic signal, such that the acoustic correction filter can filter the signal in accordance with the further determined correction characteristic so as to create the artificial sound as if heard at the particular location.

The inventive method makes it possible to design an acoustic correction filter having a characteristic that corrects or compensates for a difference between the first sample signal detected from vibration of the string while using the given suppression means such as the mute attachment to suppress vibration of the support member and the second sample signal detected from the vibration of the string while not using the given suppression means to suppress vibration. Accordingly, when the acoustic correction filter designed by the inventive method is used to filter a signal that is detected while using the suppression means to suppress vibration, it is possible to output an artificial or synthetic sound having almost the same characteristic as that of a natural sound generated while not using the suppression means to suppress vibration. Even if vibration of the bridge or the like is suppressed or arrested by the mute attachment on the stringed instrument for mute performance, an original signal can be obtained from vibration of a string. When the obtained signal is made to pass through the acoustic correction filter designed as mentioned above, the original signal can be converted into a modified signal having almost the same characteristic as that of a signal detected under the free state where no vibration is suppressed.

In another aspect of the invention, there is provided a method of forming an acoustic correction filter applicable to a stringed instrument composed of a string member operable to undergo a vibration, a support member for supporting the string member, a body member responsive to the vibration transmitted through the support member for generating a natural sound and a mute attachment for muting the natural sound. The acoustic correction filter is operable when the natural sound is muted by the mute attachment for filtering a signal derived from the vibration so as to create an artificial sound instead of the muted natural sound. The inventive method comprises the steps of acquiring a first sample signal from the vibration under a mute state where the transmittance of the vibration to the body member is suppressed by the mute attachment to mute the natural sound, acquiring a second sample signal from the vibration under a free state where the body member is allowed to generate the natural sound in response to the vibration transmitted to the body member, extracting a difference between the acquired first sample signal and the acquired second sample signal, determining a correction characteristic of the acoustic correction filter based on the extracted difference, and forming the acoustic correction filter in accordance with the determined correction characteristic such that the acoustic correction filter can filter the signal so as to create the artificial sound comparable to the natural sound.

In a further aspect of the invention, there is provided an apparatus for determining a correction characteristic of an acoustic correction filter applicable to a stringed instrument composed of a string member operable to undergo a vibration, a support member for supporting the string member, a body member responsive to the vibration transmitted through the support member for generating a natural sound and a mute attachment for muting the natural sound. The acoustic correction filter is operable when the natural sound is muted by the mute attachment for filtering a signal derived from the vibration so as to create an artificial sound instead of the muted natural sound. The inventive apparatus comprises an input section that inputs a first sample signal derived from the vibration under a mute state where the transmittance of the vibration to the body member is suppressed by the mute attachment to mute the natural sound, and inputs a second sample signal derived from the vibration under a free state where the body member is allowed to generate the natural sound in response to the vibration transmitted to the body member, an extracting section that extracts a difference between the inputted first sample signal and the inputted second sample signal, and a determining section that determines the correction characteristic of the acoustic correction filter based on the extracted difference such that the acoustic correction filter can filter the signal in accordance with the determined correction characteristic so as to create the artificial sound comparable to the natural sound.

In a still further aspect of the invention, there is provided an apparatus for outputting an acoustic signal applicable to a stringed instrument composed of a string member operable to undergo a vibration, a support member for supporting the string member, a body member responsive to the vibration transmitted through the support member for generating a natural sound and a mute attachment for muting the natural sound. The inventive apparatus is operable when the natural sound is muted by the mute attachment for outputting the acoustic signal representative of an artificial sound instead of the muted natural sound. The inventive apparatus comprises an acquiring section that acquires a first sample signal from the vibration under a mute state where the transmittance of the vibration to the body member is suppressed by the mute attachment to mute the natural sound, and acquires a second sample signal from the vibration under a free state where the body member is allowed to generate the natural sound in response to the vibration transmitted to the body member, an extracting section that extracts a difference between the acquired first sample signal and the acquired second sample signal, a determining section operable based on the extracted difference to determine a correction characteristic for a performance signal inputted by performing a stringed instrument under the mute state, and an acoustic filter section having a filter that filters the performance signal in accordance with the determined correction characteristic so as to create the acoustic signal representative of the artificial sound comparable to the natural sound.

Optionally, the stringed instrument has a plurality of mute attachments that can be selectably attached to the stringed instrument to mute the natural sound in different manners, and the determining section determines a plurality of correction characteristics in correspondence to the plurality of the mute attachments. In such a case, the inventive apparatus further comprises a selecting section that selects one of the plurality of the correction characteristics for enabling the filter to create the acoustic signal representative of the artificial sound under the mute state held by the mute attachment corresponding to the selected correction characteristic.

Practically, the determining section includes an inverting section for inverting a frequency characteristic of the second sample signal and a collecting section for collecting an acoustic signal corresponding to the natural sound from a particular location under the free state where the natural sound is generated by the body member of the stringed instrument, thereby further determining an additional correction characteristic based on the inverted frequency characteristic of the second sample signal and a characteristic of the collected acoustic signal. The acoustic filter section has an additional filter that can filter the performance signal in accordance with the additional correction characteristic so as to create the artificial sound as if heard at the particular location.

Further expediently, the determining section determines a plurality of additional correction characteristics in correspondence to a plurality of particular locations which are differently situated in a sound field of the natural sound. The inventive apparatus further comprises a selecting section that selects one of the plurality of the additional correction characteristics for enabling the additional filter to create the acoustic signal representative of the artificial sound as if heard at the particular location corresponding to the selected additional correction characteristic.

DETAILED DESCRIPTION OF THE INVENTION

Embodiments of the present invention will be described in further detail with reference to the accompanying drawings.

A. Acoustic Reproduction Apparatus and Violin

Figure 1:
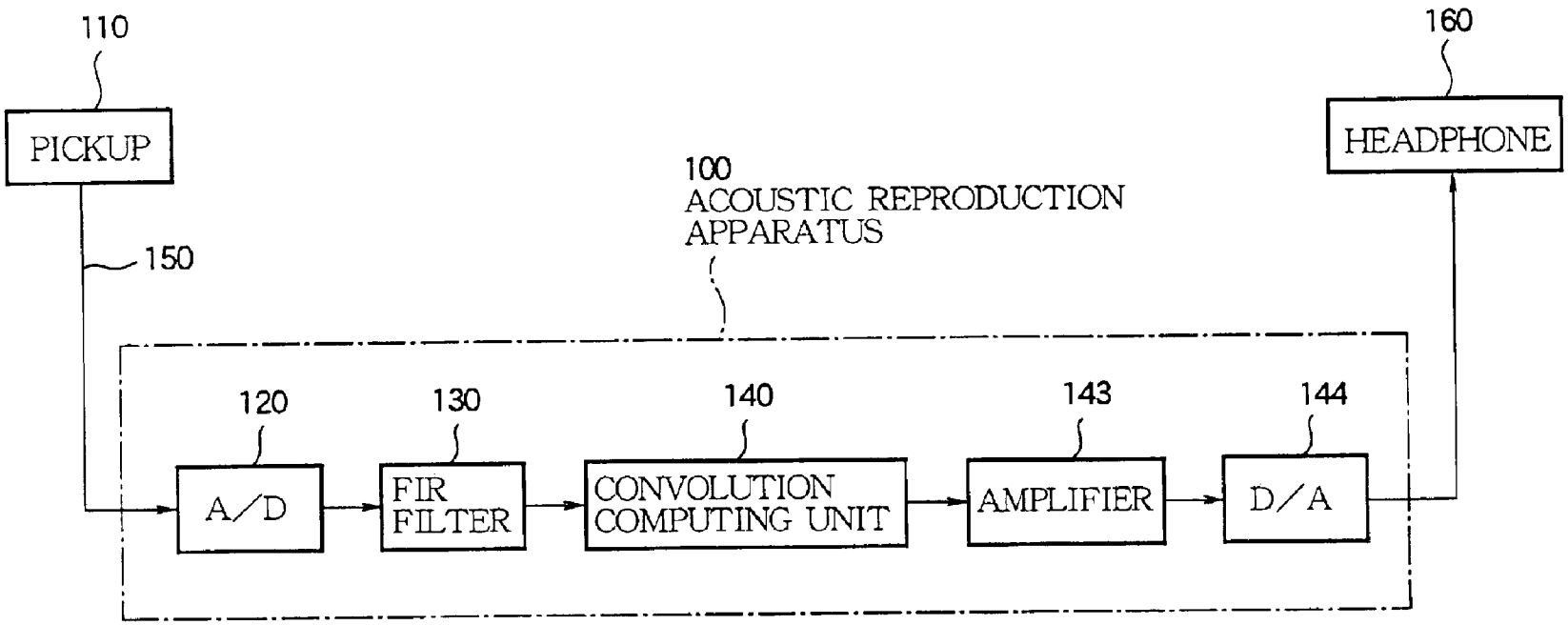
FIG. 1 is a block diagram showing configuration of an acoustic reproduction apparatus according to an embodiment of the present invention.
Figure 2:
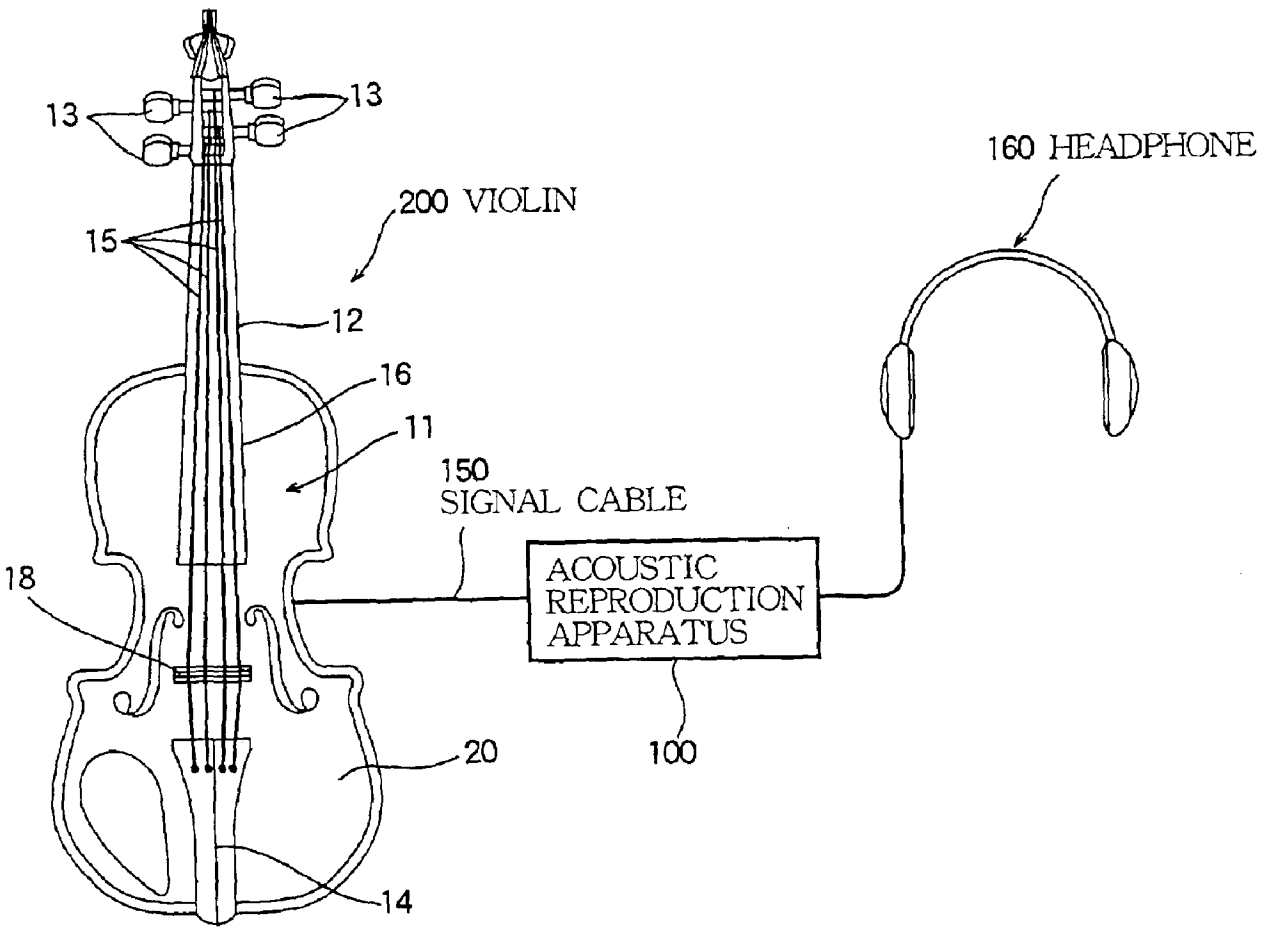
FIG. 2 schematically shows an arrangement for using the acoustic reproduction apparatus to provide mute performance of a violin.

FIG. 1 shows a configuration of an acoustic reproduction apparatus (acoustic signal output apparatus) according to an embodiment of the present invention and a violin (stringed instrument) that can be connected to the acoustic reproduction apparatus for mute performance. FIG. 2 shows external views of the acoustic reproduction apparatus and the violin.

Like an ordinary acoustic violin as shown in FIG. 2, a violin 200 connecting with an acoustic reproduction apparatus 100 according to the present invention has a belly (sound generation member) 11 as a resonance body and a neck 12 extending from a neck 12. Tuning pegs 13 on the neck 12 and a tailpiece 14 on the belly 11 support four strings 15 with tension applied. A fingerboard 16 is arranged almost parallel to the strings 15 on the top surface (as shown in the figure) of the belly 11 and neck 12. A bridge (support member) 18 is sandwiched between the belly 11 and the strings 15 and transmits vibration of the string 15 to the belly 11. These components have the same functions as those of ordinary acoustic violins. During normal performance without mute performance, the violin 200 generates sound on the same principle as for ordinary acoustic violins, i.e., sounds acoustically.

The acoustic reproduction apparatus 100 can be provided with an attachment so that the apparatus can be attached to a performer's waist belt or the like. By doing so, the performer can play the violin in a natural posture without concern for the position of the acoustic reproduction apparatus 100 and the like.

Figure 3:
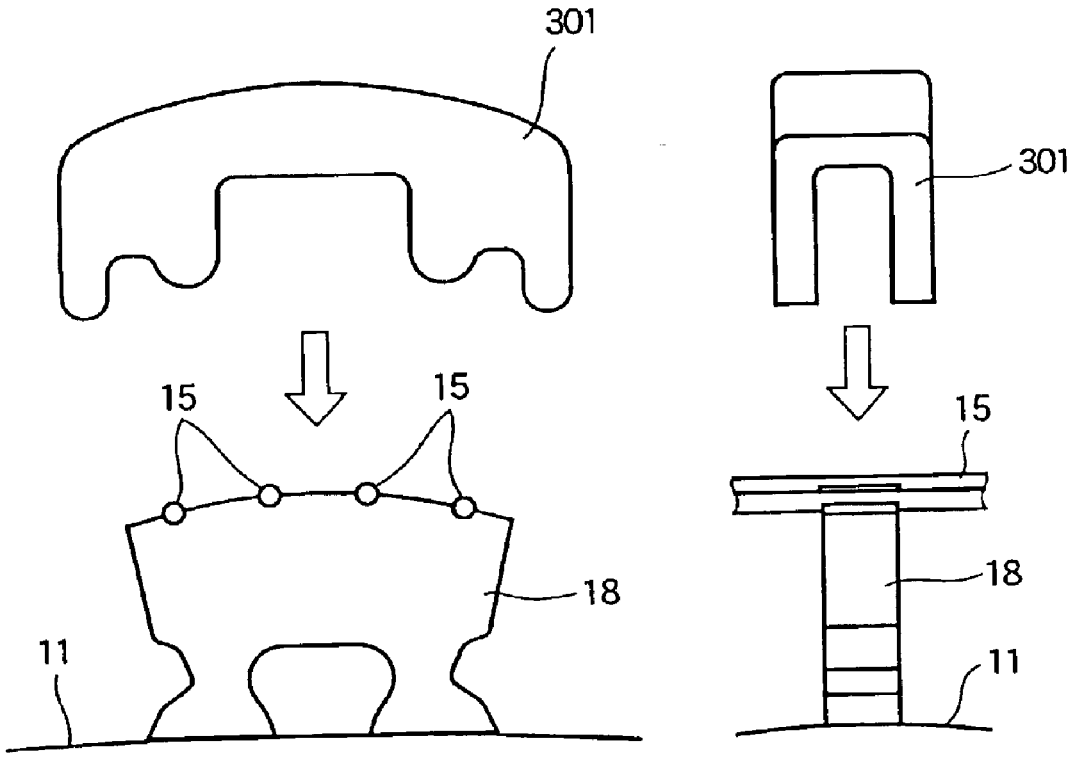
FIG. 3 shows a mute member attached to a bridge of the violin for the mute performance.

It is necessary to transmit vibration of the bridge 18 as little as possible to the belly 11 so that the acoustic violin 200 is capable of mute performance. A mute member is used as a means for suppressing the vibration transmission. FIG. 3 exemplifies a mute member that suppresses vibration of the bridge 18. As shown in FIG. 3, the mute member 301 made of an elastic material such as metal or rubber. The mute member 301 is placed on the top of the bridge 18 that touches the strings 15 to suppress vibration of the bridge 18 in accordance with vibration of the rubbed strings 15 during performance and the like. Suppressing the vibration of the bridge 18 during performance can decrease the amount of vibration transmitted to the belly 11 (see FIG. 2) and therefore decrease the volume of generated sound.

For the purpose of mute performance, the mute member 301 having the above-mentioned configuration is attached to the bridge 18 to control the amount of acoustically generated musical sound. On the other hand, it is necessary to generate a musical sound corresponding to the performance from a headphone 160. According to the embodiment, the bridge 18 of the violin 200 is provided with a pickup 110 that detects vibration of the bridge 18, converts the vibration energy into an electric energy, and outputs an electric signal (detected signal). The detected signal from the pickup 110 reflects the performance operation and is output to the acoustic reproduction apparatus 100 via a signal cable 150, allowing headphone 160 to output a musical sound corresponding to the performance operation.

The following describes the acoustic reproduction apparatus 100 that generates a musical sound from the headphone 160 based on a signal supplied via the signal cable 150 from the pickup 110 attached to the bridge 18 of the violin 200 as mentioned above. As shown in FIG. 1, the acoustic reproduction apparatus 100 comprises an A/D converter 120, an FIR (Finite Impulse Response) filter 130, a convolution computing unit (second acoustic correction filter) 140, an amplifier 143, and a D/A converter 144.

When the pickup 110 is attached to the bridge 18 (see FIG. 2) of the violin 200, the A/D converter 120 converts an electric signal supplied from the pickup 110 via the signal cable 150 into a digital signal and outputs this signal to the FIR filter 130.

The FIR filter 130 is assigned a filter coefficient corresponding to filter characteristics derived by a filter characteristic derivation method (to be described) and provides a signal process in accordance with the filter coefficient specified for the electric signal supplied from the A/D converter 120. The FIR filter 130 is provided with the filter characteristic derived by the filter characteristic derivation method and processes signals as follows. When the mute member 301 (see FIG. 3) suppresses vibration of the bridge 18, the FIR filter 130 is supplied with the characteristic of a signal detected by the pickup 110. The FIR filter 130 adjusts this characteristic to almost the same characteristic of a signal detected with the mute member 301 not attached, i.e., in a natural manner of generating musical sounds. With the mute member 301 attached, the detected electric signal passes through the FIR filter 130 and is output after converted into a signal having almost the same characteristic as that of the electric signal that is detected with the mute member 301 not attached.

When the FIR filter 130 supplies the electric signal with the corrected frequency characteristic, the convolution computing unit 140 convolutes this signal with an impulse response (coefficient sequence) that is derived by an impulse response derivation method to be described. In this manner, the convolution computing unit 140 reflects a specified sound field characteristic on the signal and outputs it as an acoustic signal to the amplifier 143.

The amplifier 143 amplifies the acoustic signal supplied from the convolution computing unit 140 in accordance with a volume specified by an operation device (not shown). The D/A converter 144 converts the acoustic signal supplied from the amplifier 143 into an analog signal and outputs it to the headphone 160 via the signal cable. In this manner, the headphone 160 generates a musical sound corresponding to the performer's operation (rubbing strings).

B. Method of Deriving Filter Characteristic and Impulse Response

There has been described the configuration of the acoustic reproduction apparatus 100 according to the embodiment and the violin 200 connected to the acoustic reproduction apparatus 100. When the pickup 110 detects a signal with the mute member 301 attached to the bridge 18, the acoustic reproduction apparatus 100 according to the embodiment uses this detected signal as the basis of a musical sound to be generated from the headphone 160. In addition, the acoustic reproduction apparatus 100 makes it possible to prevent the sound quality from degrading and reproduce the sound field more faithfully. The embodiment is characterized by methods of deriving (designing) characteristics of the FIR filter 130 for implementing these features and deriving an impulse response defined for the convolution computing unit 140. That is to say, the embodiment is characterized by methods of deriving characteristics of acoustic correction filters such as the FIR filter 130 and the convolution computing unit 140. These derivation methods will be described in detail below.

B-1. Method of Deriving FIR Filter Characteristics

When the pickup 110 detects a signal caused by vibration of the bridge 18 whose vibration is decreased by the mute member 301, the detected signal needs to be corrected to a signal detected with the mute member 301 not attached, i.e., to a signal with no degradation of the sound quality due to attachment of the mute member 301. For this purpose, a filter characteristic needs to be defined for the FIR filter 130. The method of deriving the filter characteristic will be described with reference to FIG. 4.

Figure 4:
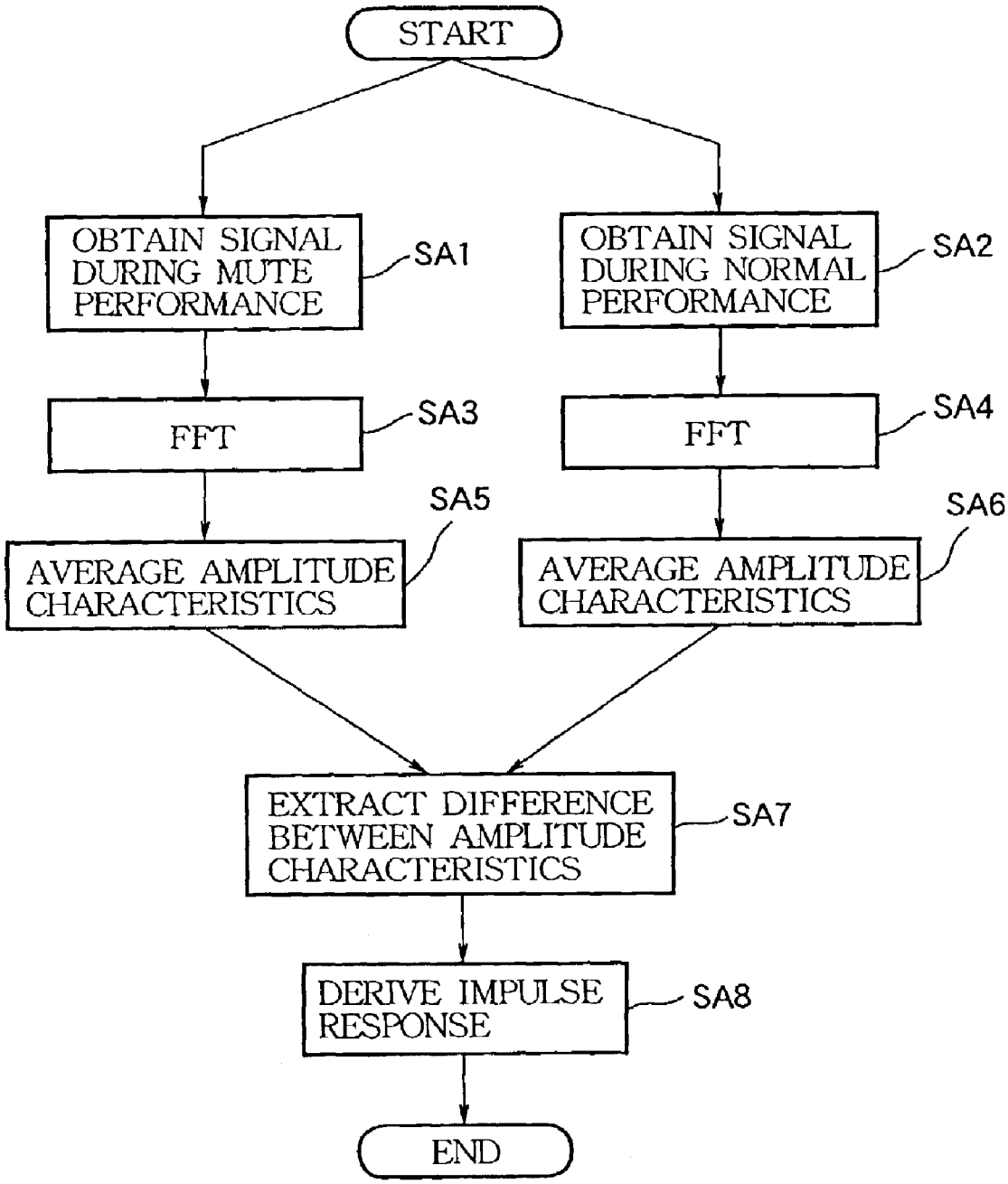
FIG. 4 is a flowchart showing a procedure to derive a filter characteristic assigned to an FIR filter as a component of the acoustic reproduction apparatus.

As shown in FIG. 4, the derivation method obtains an electric signal detected by the pickup 110 (step SA1) when a performer plays the violin 200 with the mute member 301 attached to the bridge 18 (hereafter referred to as the mute performance). Concurrently, the derivation method obtains an electric signal detected by the pickup 110 (step SA2) when the mute member 301 is not attached to the same violin, i.e., when the performer plays the violin as a natural musical instrument (hereafter referred to as the normal performance). Here, both performances have the same contents to obtain electric signals. The embodiment enables the sweep performance that smoothly changes pitches, providing waveforms almost free of peaks and dips at all frequencies.

The method applies the fast Fourier transform to the electric signals sampled by the respective test performances within a given time period and derives an amplitude characteristic on a frequency axis of each signal (steps SA3 and SA4). The method then averages the derived amplitude characteristics on the frequency axis according to the arithmetic mean and the running mean (steps SA5 and SA6).

Figure 5:
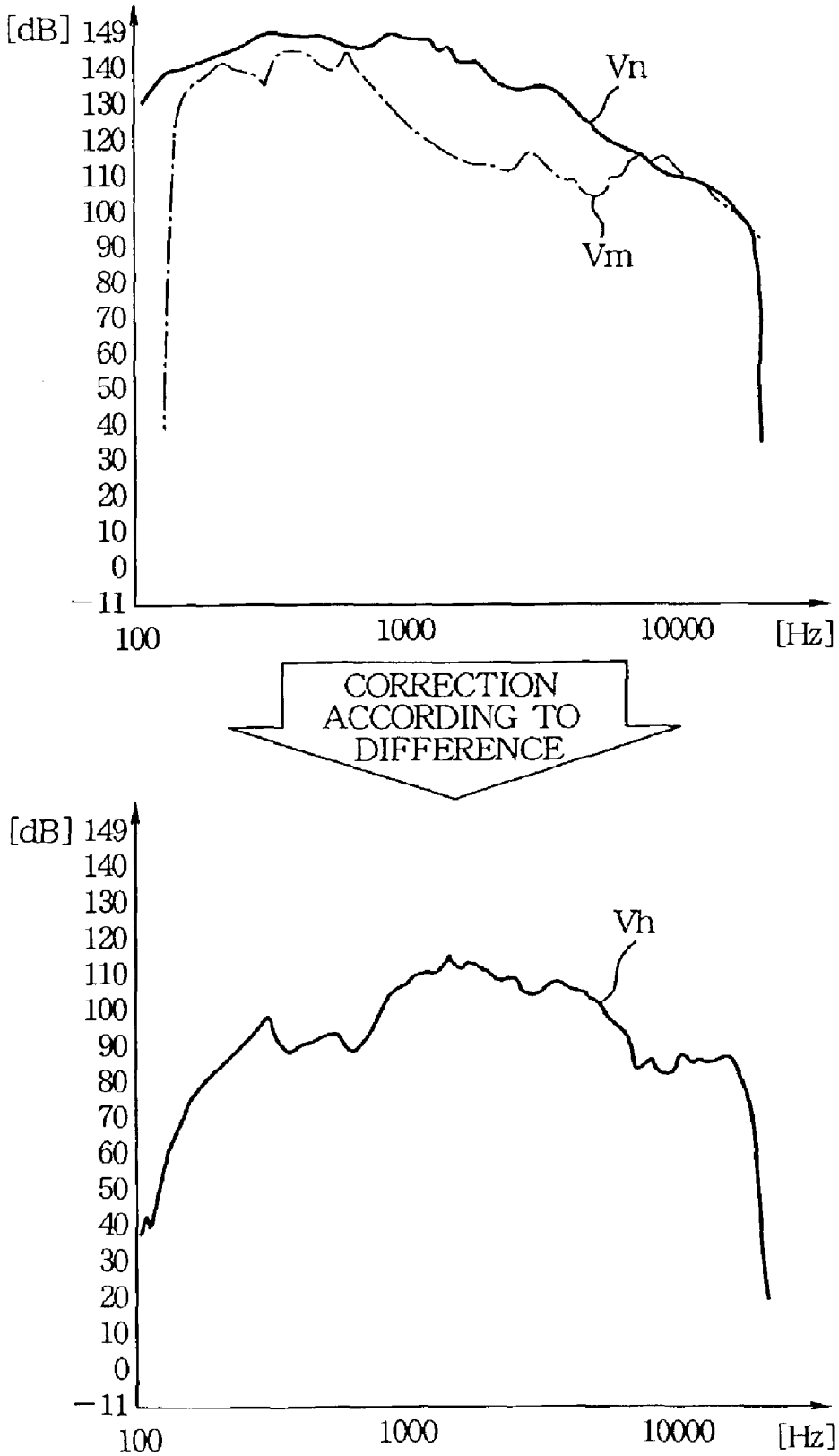
FIG. 5 illustrates a method of deriving the filter characteristic by depicting amplitude characteristics on a frequency axis of a sample signal used to derive the filter characteristic.

After obtaining the amplitude characteristics for the mute performance and the normal performance, the method extracts a difference between these amplitude characteristics (step SA7) to derive a correction characteristic. As shown in the upper part of FIG. 5, for example, the mute performance yields an amplitude characteristic Vm. The normal performance yields an amplitude characteristic Vn. In this case, the method finds a correction characteristic Vh for amplitudes on the frequency axis as shown in the lower part of FIG. 5 based on the difference between these amplitude characteristics Vm and Vn, i.e., a ratio thereof. That is to say, the method finds the correction characteristic Vh that is added to the amplitude characteristic Vm for the mute performance to produce the amplitude characteristic Vn for the normal performance.

Figure 6:
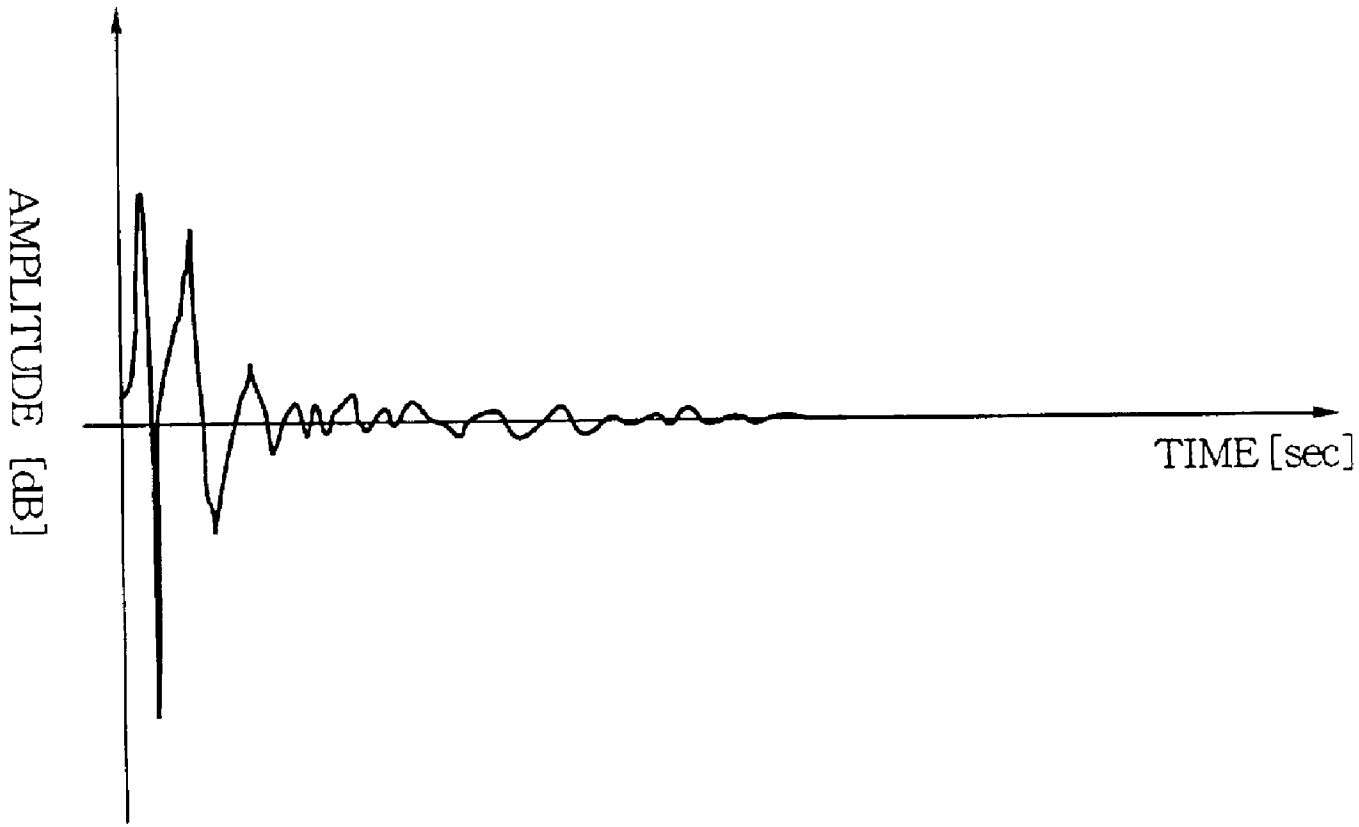
FIG. 6 exemplifies an impulse response derived by the filter characteristic derivation method.

After the correction characteristic Vh is found as mentioned above, the method finds an impulse response as shown in FIG. 6 (step SA8) by providing the correction characteristic Vh with a phase characteristic that satisfies the minimum phase condition. After the impulse response is obtained by providing the correction characteristic Vh with phase characteristic satisfying the minimum phase condition, the method determines that the impulse response to be a filter characteristic for the FIR filter 130. More specifically, the method determines a level value at each position on the time axis of the impulse response to be a filter coefficient assigned to the FIR filter 130.

As mentioned above, the filter design includes the process of deriving the filter characteristic for the FIR filter according to the difference in amplitude characteristics of the signals detected by the pickup 110 during the mute performance and the normal performance. The filter is created according to this filter design and is mounted on the acoustic reproduction apparatus 100. By using the FIR filter 130 designed in this manner, it is possible to correct an initial signal with degraded sound quality due to attachment of the mute member 301 to the bridge 18 into an artificial signal having almost the same characteristic of a natural signal that is obtained with the mute member 301 not attached. When the pickup 110 supplies an electric signal to the acoustic reproduction apparatus 100 during the mute performance, the FIR filter 130 outputs a signal having almost the same characteristic of a signal that is detected with the mute member 301 not attached. The headphone 160 generates a musical sound in accordance with the signal output via the convolution computing unit 140. The audience can listen to the musical sound very similar to that produced in a natural condition.

As mentioned above, the FIR filter 130 has the filter characteristic determined by the filter characteristic derivation method. The FIR filter 130 references an amplitude difference in the sample signals detected by the pickup 110 during the mute performance and the normal performance and corrects the amplitude for the corresponding difference. The FIR filter 130 corrects a signal detected by the pickup 110 during the mute performance as if the pickup 110 detects the signal during the normal performance. This is based on the following reason.

We directed our attention to the fact that the harmonics distribution hardly changes in a signal whether it is detected by the pickup 110 during the mute performance or the normal performance. We confirmed that it is possible to obtain a signal having almost the same characteristic as that for a signal detected by the pickup 110 during the normal performance by correcting a signal detected by the pickup 110 during the mute performance in accordance with the amplitude difference for each frequency. It has been proved that a good result is obtained by correcting amplitudes correspondingly to amplitude differences on the basis of each frequency of signals detected by the pickup 110 during the mute performance and the normal performance. Based on the proved contents, we adopted the FIR filter 130 having the above-mentioned filter characteristic.

B-2. Method of Deriving an Impulse Response (Filter Coefficient) Assigned to the Convolution Computing Unit We assumed that sufficient linearity is maintained between a first transmission process of converting the bridge vibration into a sound by vibrating the musical instrument's body and a second transmission process of delivering the sound generated from the musical instrument to an ear (tympanic membrane) via the space. We also assumed that the above-mentioned two transmission processes are fully simulated by adding the linear conversion of convoluting an impulse response in the signal detected by the pickup 110 and thus the headphone generates a sound faithful to the normal performance. The acoustic reproduction apparatus 100 according to the embodiment adopts the FIR filter 130 having the filter characteristic determined by the above-mentioned method and corrects a signal degraded by attachment of the mute member 301. In addition, the acoustic reproduction apparatus 100 uses the convolution computing unit 140 to convolute the corrected signal with an impulse response and reproduces the sound field as if the headphone 160 delivers a musical sound generated near the belly 11 of the violin 200. While the embodiment uses one convolution computing unit 140 to simulate the first and second transmission processes, it may be preferable to find impulse responses individually and provide convolution computing units for simulating the first and second transmission processes, respectively.

Figure 7:
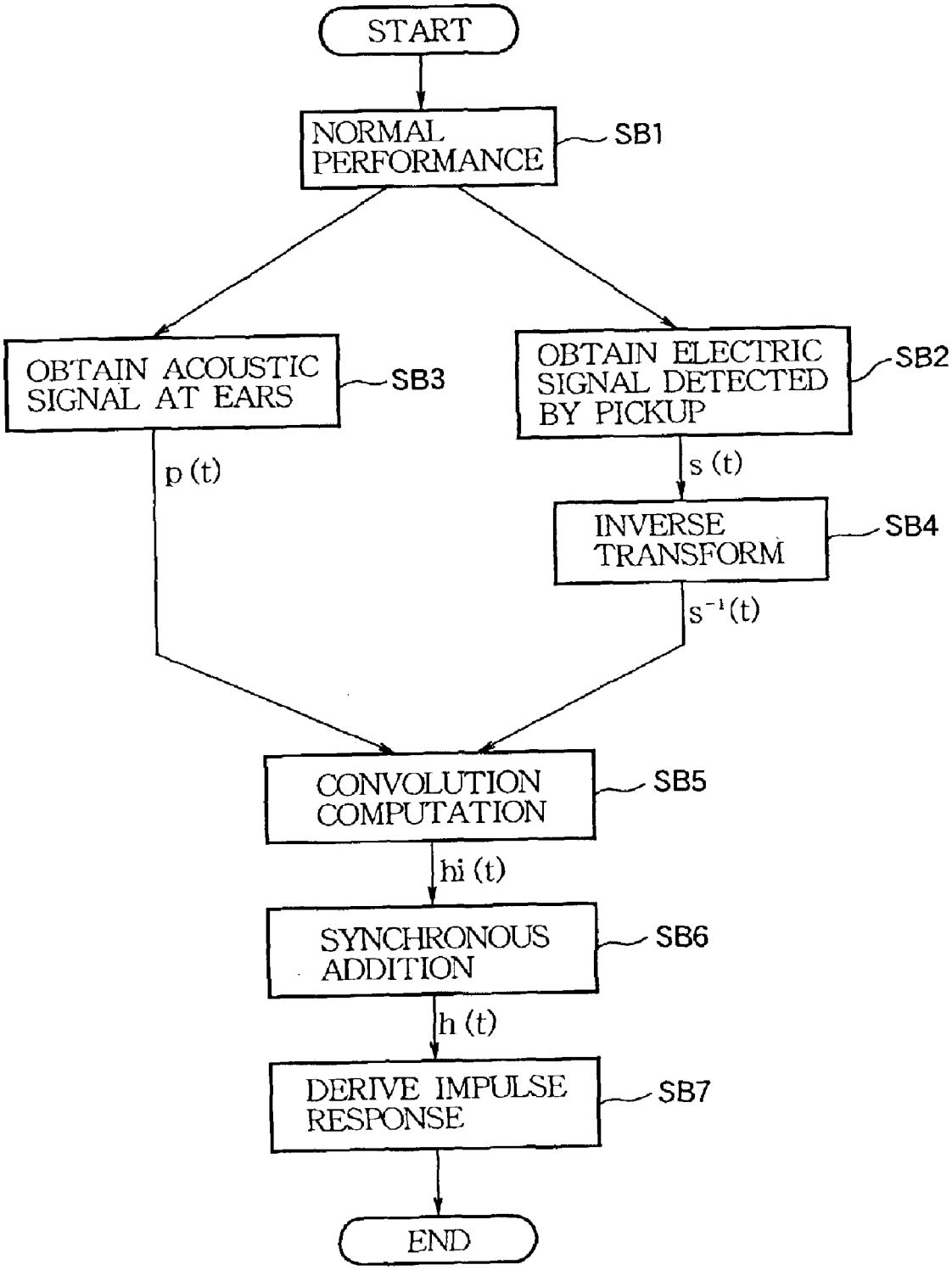
FIG. 7 is a flowchart showing a procedure to derive an impulse response assigned to a convolution computing unit as a component of the acoustic reproduction apparatus.

Referring now to FIG. 7, the following describes the method of deriving an impulse response (filter coefficient sequence) assigned to the convolution computing unit 140 in order to reproduce the sound field including these two transmission processes.

As shown in FIG. 7, the derivation method uses a performance with the mute member 301 not attached to the violin 200, i.e., in the same state as for the natural musical instrument (normal performance) and obtains an electric signal detected by the pickup 110 at this time (step SB2). During the normal performance, the method obtains not only the electric signal detected by the pickup 110 as mentioned above, but also an acoustic signal (sound generated by the performance of the violin 200) picked up by microphones positioned at both ears of a performer of the violin 200 during the normal performance (step SB3). In order to obtain electric signals, the method uses the sweep performance that smoothly changes pitches to provide waveforms almost free of peaks and dips at all frequencies. The test performance for obtaining sample signals may be held in any place such as an anechoic room, a concert hall, and the like. An impulse response generated on the basis of the obtained signal will have a characteristic that reproduces the conversion from the bridge vibration into sounding of the musical instrument itself and the sound field (reverberant sound and the like in the room space) used for the performance. The performance can be conducted to obtain sample signals in an environment appropriate for the sound field to be reproduced.

After obtaining the electric signal detected by the pickup and the acoustic signal at the ears during the normal performance as mentioned above, the method inversely converts the electric signal s(t) detected by the pickup (step SB4) to obtain a signal $s^{-1}(t)$ that should satisfy an equation $s(t)\times s^{-1}(t)=1$.

The method then convolutes the inversely converted signal $s^{-1}(t)$ with the acoustic signal p(t) picked up by the microphone (step SB5) and synchronously adds or sums a convolution result hi(t) (step SB6) to derive an impulse response $h(t)=\Sigma hi(t)$ (step SB7).

After finding the impulse response h(t), the method specifies it as a filter characteristic for the convolution computing unit 140. More specifically, a level value at each position on the time axis of the impulse response is specified as a coefficient to be assigned to each multiplier constituting the convolution computing unit 140.

The above-mentioned technique derives the impulse response using the electric signal detected by the pickup 110 during the normal performance and the acoustic signal picked up by the performer's ears during the normal performance. When a signal is supplied from the pickup and passes the FIR filter 130, the convolution computing unit 140 convolutes this signal with the derived impulse response. Accordingly, the acoustic reproduction apparatus 100 can reproduce the sound field as if the musical sound from the headphone 160 were generated from the vicinity of the belly 11 of the violin 200. When the normal performance is held to obtain sample signals in a concert hall and the like, the reproduced signals are also provided with reverberant sound characteristics and the like in the concert hall. A person listening to the sound from the headphone 160 can feel the sound field similar to the concert hall.

Also during the performance using the mute member 301 attached to the bridge 18, the acoustic reproduction apparatus 100 according to the embodiment allows the FIR filter 130 having the derived filter characteristic to correct the detected signal generated by vibration of the bridge 18 attached with the mute member 301. This suppresses degradation of signals due to attachment of the mute member 301. Moreover, the convolution computing unit 140 convolutes the corrected signal with the derived impulse response. The performer can obtain an impression as if the musical sound from the headphone 160 were generated from the vicinity of the belly 11. Therefore, attaching the mute member 301 can decrease the volume of actually generated musical sound and ease noise problems for the people outside. On the other hand, the performer can play the violin by listening to musical sound from the headphone 160 almost in the same atmosphere as he or she plays the violin 200 acoustically. Furthermore, the performer uses the ordinary acoustic violin 200 though attached with the mute member 301. Of course, performance feelings and the like are almost the same as those on the acoustic violin.

C. Modifications

The present invention is not limited to the above-mentioned embodiments and may be embodied in various modifications as follows.

(Modification 1)

The acoustic reproduction apparatus 100 according to the embodiment comprises the FIR filter 130 assigned with one derived filter characteristic and the convolution computing unit 140 to convolute with the one derived filter characteristic. It may be preferable to appropriately change either or both of the filter characteristic of the FIR filter 130 and the impulse response convoluted by the convolution computing unit 140.

Figure 8:
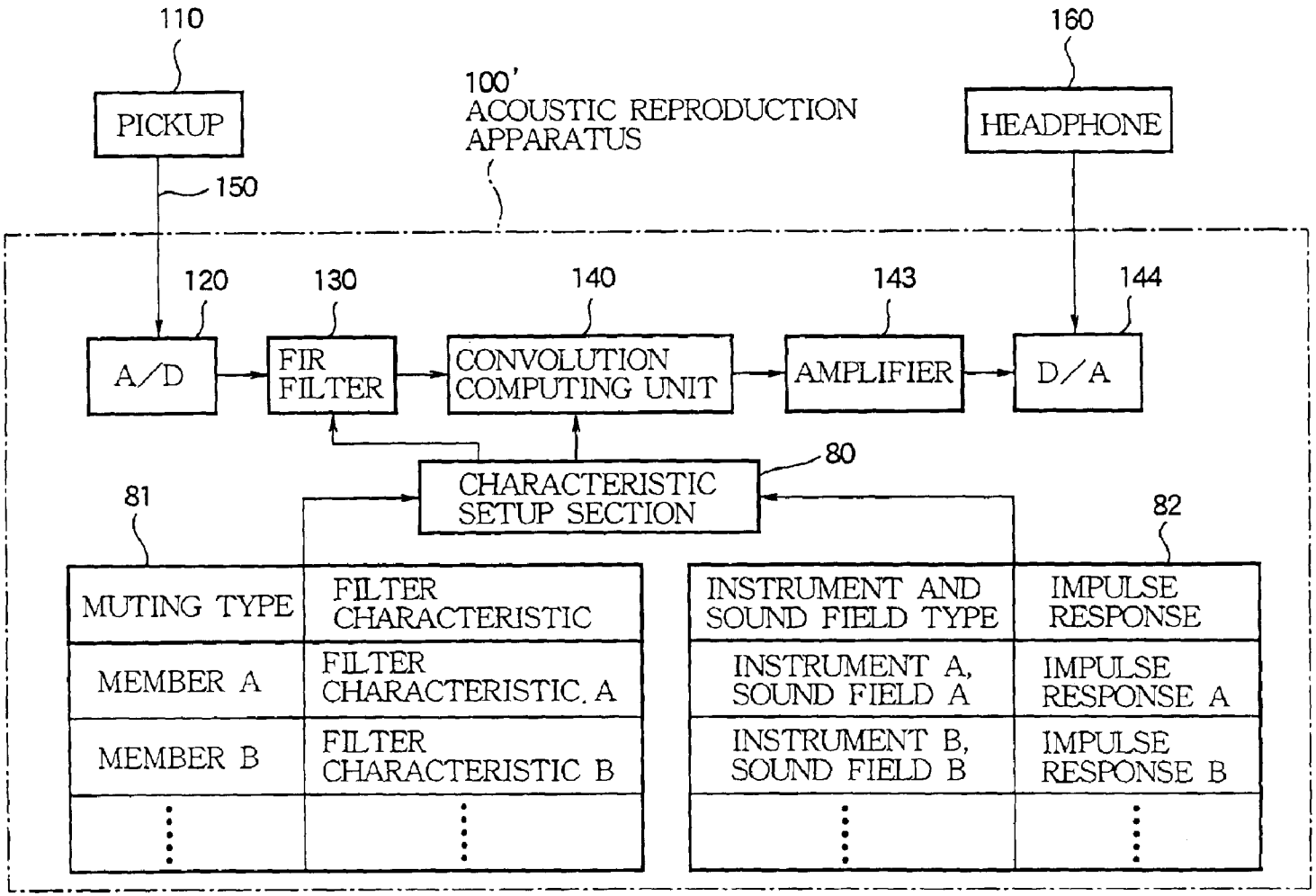
FIG. 8 shows a configuration of a modification of the acoustic reproduction apparatus.

As shown in FIG. 8, for example, it may be preferable to implement the same mute performance as the above-mentioned embodiment by using an acoustic reproduction apparatus 100' that further comprises a characteristic setup section (characteristic selection means or selection means 80, a filter characteristic storage section 81, and an impulse response storage section 82 in addition to the configuration of the acoustic reproduction apparatus 100.

The characteristic setup section 80 in FIG. 8 follows an instruction of a user (performer and the like) entered from a group of switches (not shown), reads a filter characteristic and an impulse response from the filter characteristic storage section 81 and the impulse response storage section 82, and assigns the read filter characteristic (filter coefficient) and the impulse response (filter coefficient) to the FIR filter 130 and the convolution computing unit 140, respectively.

The filter characteristic storage section 81 stores the type (product type) of the mute member attached to the bridge 18 of the violin 200 and the filter characteristic (filter coefficient) correspondingly to each other. Each filter characteristic stored in the filter characteristic storage section 81 is found as follows. A filter characteristic A corresponds to a mute member type "member A". During the performance using the mute member A attached to the bridge 18, the filter characteristic A is used for the correction corresponding to an amount equivalent to a difference between a signal detected by the pickup 110 and a signal detected by the pickup 110 during the normal performance. The same technique (see FIG. 4) as the above-mentioned embodiment is used to find the filter characteristic A. On the other hand, a filter characteristic B corresponds to a mute member type "member B". During the performance using the mute member B attached to the bridge 18, the filter characteristic B is used for the correction corresponding to an amount equivalent to a difference between a signal detected by the pickup 110 and a signal detected by the pickup 110 during the normal performance. The same technique (see FIG. 4) as the above-mentioned embodiment is used to find the filter characteristic B. The filter characteristic storage section 81 stores filter characteristics that are found in accordance with the same technique as the above-mentioned embodiment through the use of signals detected by the pickup 110 under the condition of attaching the mute member indicated by the mute member type.

The characteristic setup section 80 receives from the user a characteristic setup instruction including the type of the mute member to be attached. The characteristic setup section 80 then reads a filter characteristic associated with the mute member type included in the instruction from the filter characteristic storage section 81 that stores a plurality of predetermined filter characteristics. The characteristic setup section 80 sets the read filter characteristic to the FIR filter 130.

The impulse response storage section 82 stores a musical instrument and sound field type and an impulse response (filter coefficient) correspondingly to each other. The musical instrument and sound field type provides information about a sound field where, which musical instrument generated a musical sound at which position in which space. In other words, this information is an impulse response for simulating the first transmission process of converting the bridge vibration into a sound by vibrating the musical instrument's body and the second transmission process of delivering the sound generated from the musical instrument to the ear (tympanic membrane) via the space. The impulse response storage section 82 stores impulse responses each of which has the following characteristic. Impulse response A is associated with musical instrument and sound field type "instrument A, sound field A" and is convoluted for a signal detected by the pickup 110 during the normal performance. Impulse response A is given such a characteristic as to produce an effect as if a musical sound output from the headphone 10 were generated by playing a violin with type A in sound field A. Impulse response B is associated with musical instrument and sound field type "instrument B, sound field B" and is convoluted for a signal detected by the pickup 110 during the normal performance. Impulse response B is given such a characteristic as to produce an effect as if a musical sound output from the headphone 10 were generated by playing a violin with type B in sound field B.

Under the condition of "instrument A, sound field A", for example, a performer plays the violin 200 (with type A) on the stage in a concert hall. The sound source is positioned to the belly 11 of the violin 200. It is intended to reproduce a sound field where a listener listens to a musical sound generated from this virtual sound source at a specific position of the auditorium in the concert hall. In this case, impulse response A is found as follows. The performer plays the violin 200 on the stage of the concert hall. During this performance, the pickup 110 is attached to the bridge 18 of the violin 200 and detects a signal. During the same performance, a microphone is installed at the specified position of the auditorium and picks up an acoustic signal. The same technique (see FIG. 7) as the above-mentioned uses these signals to find the impulse response. The impulse response storage section 82 stores the determined impulse response as impulse response A corresponding to "instrument A, sound field A".

The characteristic setup section 80 receives from the user a characteristic setup instruction including the musical instrument and sound field type to be reproduced. The characteristic setup section 80 then reads an impulse response corresponding to the musical instrument and sound field type included in the instruction from the impulse response storage section 82 that stores a plurality of predetermined impulse responses. The characteristic setup section 80 assigns the read impulse response (filter coefficient) to the convolution computing unit 140.

The FIR filter 130 is thus assigned with the filter characteristic according to the user's instruction. A signal process according to the setup contents is performed for the signal supplied to the acoustic reproduction apparatus 100' from the pickup 110. When the user supplies a setup instruction including the type of the mute member attached to the bridge 18 of the violin 200 during the performance, the FIR filter 130 is assigned with the filter characteristic corresponding to the specified type of the mute member. With this filter characteristic specified, the acoustic reproduction apparatus 100' may be supplied with the signal detected by the pickup 110 from the bridge attached with the mute member. The FIR filter 130 converts the supplied signal into a signal having almost the same characteristic of the signal detected by the pickup 110 with the mute member not attached. While various mute members can be attached to the violin 200, the acoustic reproduction apparatus 100' can provide a correction process appropriate the attached mute member when the user supplies a setup instruction including the type of the attached mute member.

The convolution computing unit 140 is assigned with an impulse response corresponding to the user-specified musical instrument and sound field type. A signal process according to the setup contents is performed for the electric signal supplied to the acoustic reproduction apparatus 100' from the pickup 110, reproducing the user-specified sound field.

(Modification 2)

The above-mentioned embodiment determines the filter characteristic of the FIR filter 130 in accordance with a difference between the signal detected by the pickup 110 with the mute member 301 attached to the violin 200 and the signal detected by the pickup 110 with the mute member 301 not attached to the violin 200. In this manner, it may be preferable to determine the filter characteristic in accordance with a difference between signals that are detected with the mute member 301 attached or not attached to the same violin 200. It may be also preferable to use another violin, e.g., with a higher grade than that of the violin 200 in order to obtain signals during the normal performance. Like the above-mentioned embodiment, the FIR filter 130 is assigned with the filter characteristic corresponding to a difference between the signal detected by the pickup attached to the bridge of the high grade violin and the signal detected by the pickup 110 of the violin 200 attached with the mute member 301. When the FIR filter 130 is assigned with the derived filter characteristic, the performer can listen to a simulated sound of the high grade violin from the headphone 160 while playing the violin 200 attached with the mute member 301.

(Modification 3)

Figure 9:
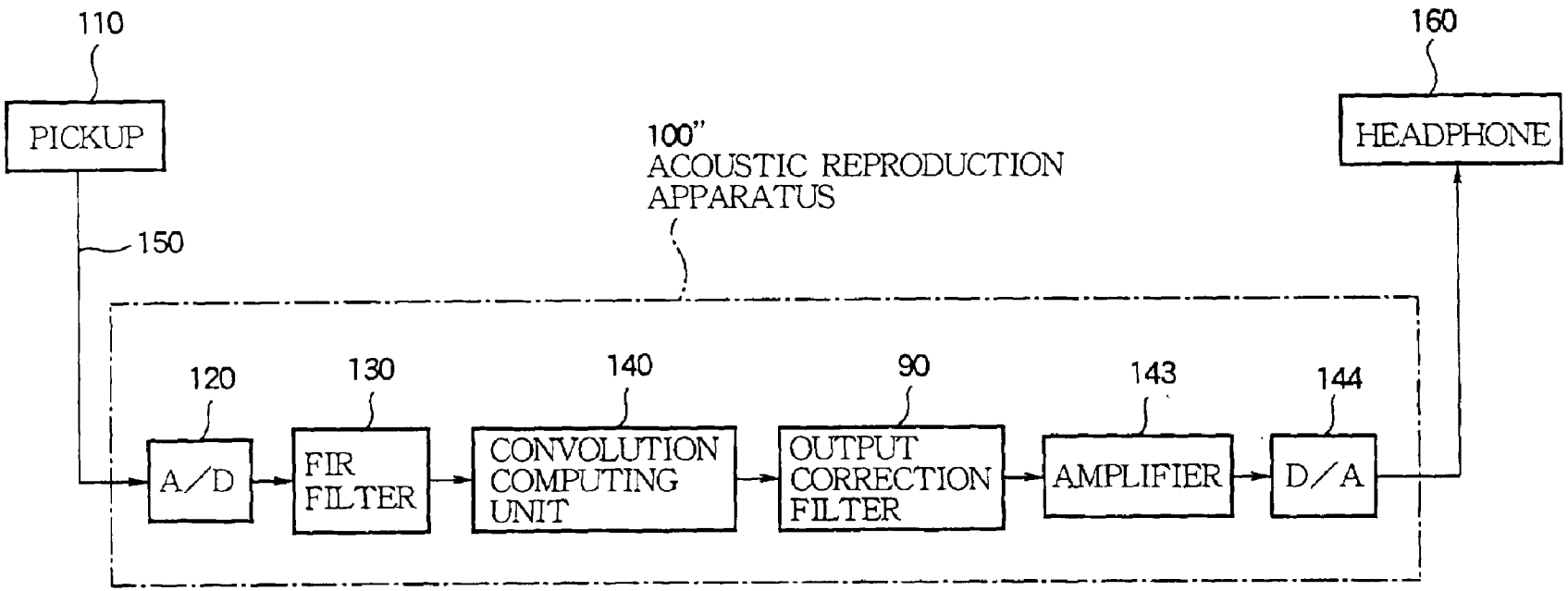
FIG. 9 shows a configuration of another modification of the acoustic reproduction apparatus.

FIG. 9 shows a configuration of an acoustic reproduction apparatus 100" provided with a reproduction correction filter 90 after the convolution computing unit 140 in the acoustic reproduction apparatus 100. It may be preferable to reproduce a sound field that makes the performer to feel as if he or she listened to a musical sound without using the headphone while actually listening to the sound from the headphone 160. More specifically, the headphone 160 is mounted on a dummy head and generates an impulse sound. A microphone picks up the impulse sound generated from the headphone 160. A signal of the received impulse sound is inversely transformed to yield a characteristic that is assigned as the filter characteristic of the reproduction correction filter 90. Since such filter characteristic is assigned to the reproduction correction filter 90, it is possible to reproduce a sound field that makes the performer to feel as if he or she listened to a musical sound without using the headphone as mentioned above.

(Modification 4)

Figure 10:
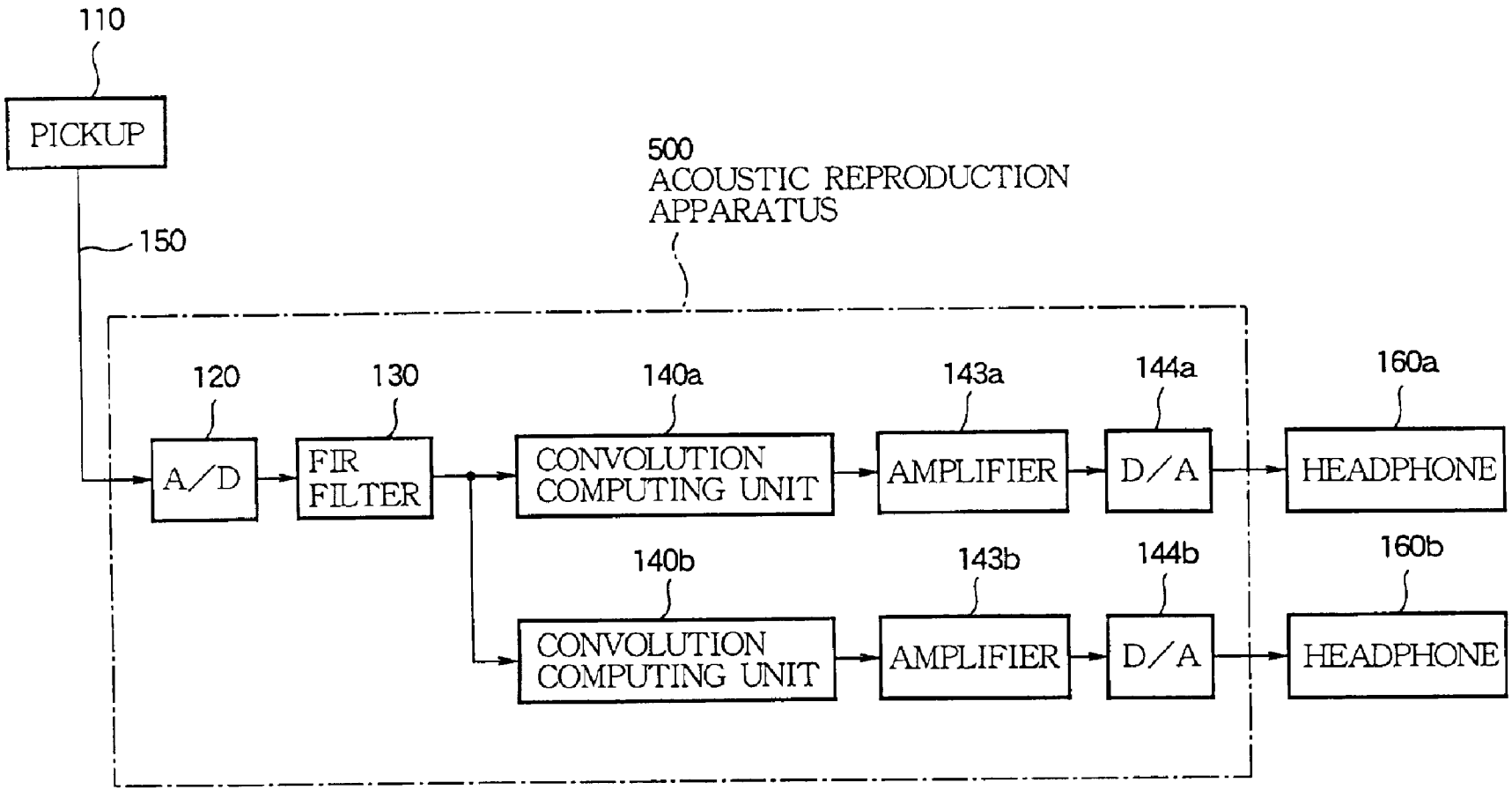
FIG. 10 shows a configuration of yet another modification of the acoustic reproduction apparatus.

FIG. 10 shows a configuration of an acoustic reproduction apparatus 500 provided with a plurality of convolution computing units 140*a* and 140*b* (two units in this example) assigned with impulse responses for reproducing different sound fields. The convolution computing unit 140*a* and 140*b* may output acoustic signals assigned with different sound field characteristics to headphones 160*a* and 160*b* via amplifiers 143*a* and 143*b* and D/A converters 144*a* and 144*b*, respectively.

For example, the convolution computing unit 140*a* may be configured to convolute an input signal with the impulse response found by the same technique as the above-mentioned embodiment. The convolution computing unit 140*b* may be configured to convolute an input signal with the impulse response for reproducing a sound field different from that of the impulse response for the convolution computing unit 140*a*. For example, the sound field for the convolution computing unit 140*b* may allow a listener to feel as if he or she listened to music played by a performer at the auditorium in a concert hall. The performer listens to the musical sound from the headphone 160*a*. Another person listens to the musical sound from the headphone 160*b*. The performer can experience the sound field as if he or she played music on the stage. The other person can experience the sound field as if he or she listened the music at the auditorium.

(Modification 5)

According to the above-mentioned embodiment, manufacturers and the like define the filter characteristic assigned to the FIR filter 130 and the impulse responses assigned to the convolution computing unit 140. The acoustic reproduction apparatus 100 may be configured to derive the filter characteristic assigned to the FIR filter 130 (configuration for implementing the process in FIG. 4) and/or derive the impulse response assigned to the convolution computing unit 140 (configuration for implementing the process in FIG. 7). It may be preferable to allow the user to determine these characteristics.

Figure 11:
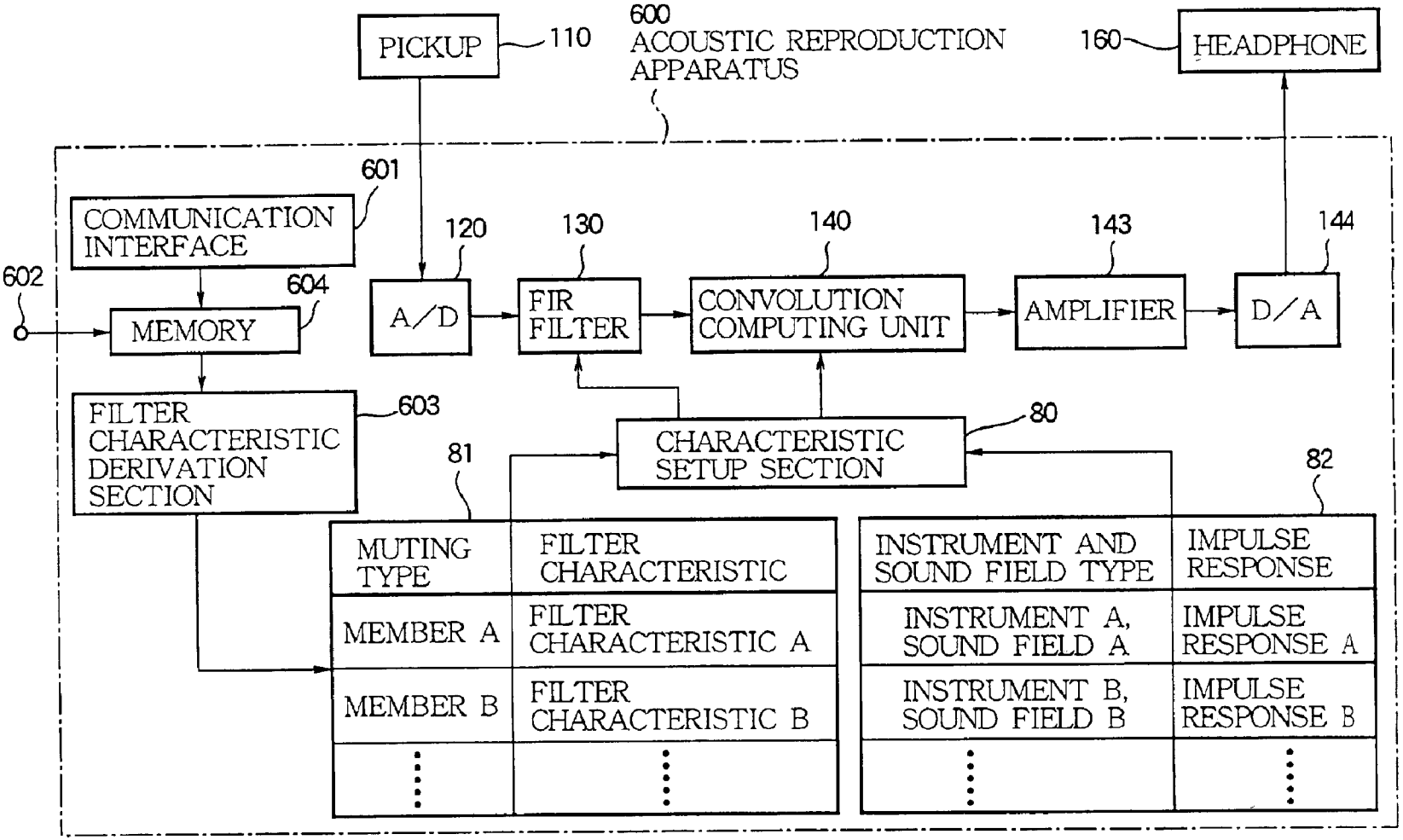
FIG. 11 shows a configuration of still another modification of the acoustic reproduction apparatus.

FIG. 11 shows a configuration of an acoustic reproduction apparatus provided with the above-mentioned characteristic derivation function. As shown in FIG. 11, an acoustic reproduction apparatus (filter characteristics determination apparatus and acoustic signal output apparatus) 600 comprises a communication interface 601, a signal input terminal 602, a filter characteristic derivation section 603, and memory 604 in addition to the above-mentioned A/D converter 120, the FIR filter 130, the convolution computing unit 140, the amplifier 143, the D/A converter 144, the characteristic setup section 80, the filter characteristic storage section 81, and the impulse response storage section 82.

The communication interface 601 functions between the apparatus and a server (not shown) connected to a network (not shown) such as the Internet and the like and interchanges data via the network. The communication interface 601 incorporates data supplied from the server and the like into the acoustic reproduction apparatus 600.

The signal input terminal 602 inputs a signal for deriving the filter characteristic assigned to the FIR filter 130 in the acoustic reproduction apparatus 600. For example, the signal input terminal 602 inputs a signal detected by the pickup 110 of the violin 200. The memory 604 stores signals supplied from the signal input terminal 602, data incorporated by the communication interface 601, and the like.

The filter characteristic derivation section 603 derives the filter characteristic according to the same technique as the above-mentioned embodiment (see FIG. 4) based on signals and data stored in the memory. The filter characteristic derivation section 603 newly writes the derived filter characteristic (filter coefficient) to the filter characteristic storage section 81.

According to the above-mentioned configuration, the acoustic reproduction apparatus 600 derives a new filter characteristic as follows. A new filter characteristic may need to be derived, e.g., when the performer purchases a new type of mute member. The following describes how to derive the filter characteristic when a new mute member is purchased.

The pickup 110 of the violin 200 is connected to the signal input terminal 602. When the violin 200 is played, the pickup 110 detects a signal. This signal is incorporated into the acoustic reproduction apparatus 600 and is stored in the memory 604. Here, the apparatus inputs a signal detected by the pickup 110 with the newly purchased mute member attached and a signal detected by the pickup 110 with the mute member not attached and stores these signals in the memory 604. The filter characteristic derivation section 603 derives a filter characteristic according to the same technique as the above-mentioned embodiment (see FIG. 4) based on the two signals stored in the memory 604. That is to say, the filter characteristic derivation section 603 derives a filter characteristic corresponding to a difference between amplitudes on the frequency axis and stores the derived filter characteristic in the filter characteristic storage section 81 in correspondence with information indicating the type of the newly purchased mute member. In this manner, the filter characteristic storage section 81 stores a new filter characteristic and assigns the stored filter characteristic to the FIR filter 130. Even when attaching the newly purchased mute member to the violin 200, the performer can prevent the quality of a musical sound output from the headphone 160 from degrading due to attachment of the mute member. It may be preferable to newly derive the filter characteristic as follows. The performer plays the violin with the mute member not attached. A signal detected by the pickup 110 is stored in the memory 604 instead of being incorporated from the signal input terminal 602. The stored signal is used to derive the filter characteristic.

A user of the acoustic reproduction apparatus 600 may otherwise need to newly derive the filter characteristic in addition to the above-mentioned case of purchasing a new mute member. The user may need to derive a filter characteristic for correcting a signal detected by the pickup 110 with the mute member attached into a signal having almost the same characteristic of a signal detected with no mute member attached to a violin other than the user's violin 200. More specifically, the user may want to enjoy timbres and the like of a violin other than his or her own violin 200 by means of musical sounds output from the headphone 160. For this purpose, it is necessary to derive the filter characteristic as mentioned above and assign it to the computing unit 140. If the user purchases another violin in this case, for example, it is possible to derive a new filter characteristic by supplying the acoustic reproduction apparatus 600 with a signal detected by a pickup for the purchased violin. However, purchasing another violin is uneconomical for the user.

According to the following method, the user's acoustic reproduction apparatus 600 can derive a new filter characteristic for providing timbre and the like of a different violin. First of all, manufacturers and the like of the violin or the acoustic reproduction apparatus 600 store signal waveform data in a server connected to the Internet and the like. The signal waveform data is detected by a pickup attached to the bridge of the violin when a plurality of specified types of violins is played in a specified manner. The user accesses the server via the Internet and the like, retrieves signal waveform data detected by the pickup of an intended violin, and downloads that data into the acoustic reproduction apparatus 600 via the communication interface 601. The signal waveform data downloaded via the Internet indicates the signal detected by the pickup of the different violin. Using this signal, the user can allow the acoustic reproduction apparatus 600 to derive a filter characteristic for simulating timbre of the different violin without purchasing a new violin. The server may store not only signal waveforms, but also impulse response data. Directly using this data as a filter coefficient can provide the same effects as those mentioned above.

(Modification 6)

According to the above-mentioned embodiment, the acoustic reproduction apparatus 100 corrects a signal detected by the pickup 110 attached to the bridge 18 of the violin 200. The headphone 160 outputs musical sound of the violin 200 attached with the mute member to implement the mute performance. The present invention can be applied to musical instruments such as a cello, a contrabass, and the like that generate musical sound by transmitting string vibration to a resonance member and the like.

As mentioned above, the present invention can output a signal capable of generating a musical sound of good quality based on a signal obtained in accordance with string vibration even when the vibration suppression means such as a mute member is attached.

What is claimed is:

1. A method of designing an acoustic correction filter applicable to a stringed instrument composed of a string member operable to undergo a vibration, a support member for supporting the string member, a body member responsive to the vibration transmitted through the support member for generating a natural sound and a mute attachment for muting the natural sound, the acoustic correction filter being operable when the natural sound is muted by the mute attachment for filtering a signal derived from the vibration so as to create an artificial sound instead of the muted natural sound, the method comprising the steps of:

acquiring a first sample signal from the vibration under a mute state where the transmittance of the vibration to the body member is suppressed by the mute attachment to mute the natural sound;

acquiring a second sample signal from the vibration under a free state where the body member is allowed to generate the natural sound in response to the vibration transmitted to the body member;

extracting a difference between the acquired first sample signal and the acquired second sample signal; and determining a correction characteristic of the acoustic correction filter based on the extracted difference such that the acoustic correction filter can filter the signal in accordance with the determined correction characteristic so as to create the artificial sound comparable to the natural sound.

2. The method according to claim 1, wherein the step of extracting comprises deriving a first amplitude profile of the first sample signal along a common frequency axis, deriving a second amplitude profile of the second sample signal along the common frequency axis, and extracting the difference between the first sample signal and the second sample signal in terms of an amplitude difference between the first amplitude profile and the second amplitude profile along the common frequency axis, and wherein the step of determining determines the correction characteristic of the acoustic correction filter based on the extracted amplitude difference.

3. The method according to claim 2, wherein the step of determining further comprises inverting a frequency characteristic of the second sample signal, collecting an acoustic signal corresponding to the natural sound from a particular location under the free state where the natural sound is generated by the body member of the stringed instrument, and further determining the correction characteristic of the acoustic correction filter based on the inverted frequency characteristic of the second sample signal and a characteristic of the collected acoustic signal, such that the acoustic correction filter can filter the signal in accordance with the further determined correction characteristic so as to create the artificial sound as if heard at the particular location.

4. A method of forming an acoustic correction filter applicable to a stringed instrument composed of a string member operable to undergo a vibration, a support member for supporting the string member, a body member responsive to the vibration transmitted through the support member for generating a natural sound and a mute attachment for muting the natural sound, the acoustic correction filter being operable when the natural sound is muted by the mute attachment for filtering a signal derived from the vibration so as to create an artificial sound instead of the muted natural sound, the method comprising the steps of:

acquiring a first sample signal from the vibration under a mute state where the transmittance of the vibration to the body member is suppressed by the mute attachment to mute the natural sound;

acquiring a second sample signal from the vibration under a free state where the body member is allowed to generate the natural sound in response to the vibration transmitted to the body member;

extracting a difference between the acquired first sample signal and the acquired second sample signal;

determining a correction characteristic of the acoustic correction filter based on the extracted difference; and forming the acoustic correction filter in accordance with the determined correction characteristic such that the acoustic correction filter can filter the signal so as to create the artificial sound comparable to the natural sound.

5. An apparatus for determining a correction characteristic of an acoustic correction filter applicable to a stringed instrument composed of a string member operable to undergo a vibration, a support member for supporting the string member, a body member responsive to the vibration transmitted through the support member for generating a natural sound and a mute attachment for muting the natural sound, the acoustic correction filter being operable when the natural sound is muted by the mute attachment for filtering a signal derived from the vibration so as to create an artificial sound instead of the muted natural sound, the apparatus comprising:

an input section that inputs a first sample signal derived from the vibration under a mute state where the transmittance of the vibration to the body member is suppressed by the mute attachment to mute the natural sound, and inputs a second sample signal derived from the vibration under a free state where the body member is allowed to generate the natural sound in response to the vibration transmitted to the body member;

an extracting section that extracts a difference between the inputted first sample signal and the inputted second sample signal; and a determining section that determines the correction characteristic of the acoustic correction filter based on the extracted difference such that the acoustic correction filter can filter the signal in accordance with the determined correction characteristic so as to create the artificial sound comparable to the natural sound.

6. An apparatus for outputting an acoustic signal applicable to a stringed instrument composed of a string member operable to undergo a vibration, a support member for supporting the string member, a body member responsive to the vibration transmitted through the support member for generating a natural sound and a mute attachment for muting the natural sound, the apparatus being operable when the natural sound is muted by the mute attachment for outputting the acoustic signal representative of an artificial sound instead of the muted natural sound, the apparatus comprising:

an acquiring section that acquires a first sample signal from the vibration under a mute state where the transmittance of the vibration to the body member is suppressed by the mute attachment to mute the natural sound, and acquires a second sample signal from the vibration under a free state where the body member is allowed to generate the natural sound in response to the vibration transmitted to the body member;

an extracting section that extracts a difference between the acquired first sample signal and the acquired second sample signal;

a determining section operable based on the extracted difference to determine a correction characteristic for a performance signal inputted by performing a stringed instrument under the mute state; and an acoustic filter section having a filter that filters the performance signal in accordance with the determined correction characteristic so as to create the acoustic signal representative of the artificial sound comparable to the natural sound.

7. The apparatus according to claim 6, wherein the stringed instrument has a plurality of mute attachments that can be selectably attached to the stringed instrument to mute the natural sound in different manners, and the determining section determines a plurality of correction characteristics in correspondence to the plurality of the mute attachments, the apparatus further comprising a selecting section that selects one of the plurality of the correction characteristics for enabling the filter to create the acoustic signal representative of the artificial sound under the mute state held by the mute attachment corresponding to the selected correction characteristic.

8. The apparatus according to claim 6, wherein the determining section includes an inverting section for inverting a frequency characteristic of the second sample signal and a collecting section for collecting an acoustic signal corresponding to the natural sound from a particular location under the free state where the natural sound is generated by the body member of the stringed instrument, thereby further determining an additional correction characteristic based on the inverted frequency characteristic of the second sample signal and a characteristic of the collected acoustic signal, and wherein the acoustic filter section has an additional filter that can filter the performance signal in accordance with the additional correction characteristic so as to create the artificial sound as if heard at the particular location.

9. The apparatus according to claim 8, wherein the determining section determines a plurality of additional correction characteristics in correspondence to a plurality of particular locations which are differently situated in a sound field of the natural sound, the apparatus further comprising a selecting section that selects one of the plurality of the additional correction characteristics for enabling the additional filter to create the acoustic signal representative of the artificial sound as if heard at the particular location corresponding to the selected additional correction characteristic.

* * * * *